US007819675B2

(12) United States Patent
Ko et al.

(10) Patent No.: US 7,819,675 B2
(45) **Date of Patent: *Oct. 26, 2010**

(54) GROUNDING MEMBER FOR CABLE ASSEMBLY

(75) Inventors: David Tso-Chin Ko, Fullerton, CA (US); Yen-Chao Tsai, Tu-Cheng (TW); Tao Wang, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/322,496

(22) Filed: Feb. 2, 2009

(65) Prior Publication Data

US 2009/0197467 A1 Aug. 6, 2009

(30) Foreign Application Priority Data

Feb. 1, 2008 (CN) ..... 2008 2 0031473 U

(51) Int. Cl.
*H01R 4/66* (2006.01)

(52) U.S. Cl. ..... 439/98

(58) Field of Classification Search . 439/607.41–607.5, 439/497, 579, 498, 98
See application file for complete search history.

(56) References Cited

U.S. PATENT DOCUMENTS 5,823,825 A * 10/1998 Murphy ..... 439/607.5
5,964,620 A * 10/1999 Takahashi et al. ..... 439/579
6,489,563 B1 * 12/2002 Zhao et al. ..... 174/88 C
6,722,898 B2 * 4/2004 Peloza et al. ..... 439/108
6,951,477 B2 * 10/2005 Tondreault et al. ..... 439/497
7,052,292 B2 * 5/2006 Hsu et al. ..... 439/98
7,214,097 B1 * 5/2007 Hsu et al. ..... 439/607.47
2004/0127078 A1 * 7/2004 Tondreault et al. ..... 439/98
2009/0197467 A1 * 8/2009 Ko et al. ..... 439/607.28
2009/0197468 A1 * 8/2009 Yu et al. ..... 439/607.28

* cited by examiner

*Primary Examiner*—T C Patel
*Assistant Examiner*—Harshad C Patel
(74) *Attorney, Agent, or Firm*—Wei Te Chung; Andrew C. Cheng; Ming Chieh Chang

(57) ABSTRACT

An cable assembly (100) includes an insulated housing (1) extending along a front-to-back direction; a plurality of contacts (2) arranged in a row and supported by the insulated housing, said contacts including three grounding contact members spaced by two pair of signal contact members; a cable (4) including two juxtaposed differential wire pairs (41) respectively enclosed by conductive shielding portions (43); a grounding member (3) including a main portion (31), three finger portions (33) extending forwardly from a front side of the main portion and two arm portions (32) formed at lateral sides of a rear segment of the main portion, said grounding member (3) securely engaged with the cable via the two arm portions thereof griping the conductive shielding portions; and the finger portions soldered to the grounding contact members, and inner conductors of the differential pairs soldered to the signal contact members, respectively.

13 Claims, 4 Drawing Sheets

GROUNDING MEMBER FOR CABLE ASSEMBLY

FIELD OF THE INVENTION

The present invention generally relates to a cable assembly, and more particularly to a grounding member used for connecting a shielding member of a cable and grounding contacts of an electrical connector.

DESCRIPTION OF PRIOR ART

Serial Advanced Technology Attachment (SATA) is an art that is different from Advanced Technology Attachment (PATA). At present, transmitting rate of a device utilizing SATA has already up to 150 MB/s or more, which is much higher than an equipment adopting PATA.

A SATA cable assembly is used for connecting a Hard Disk (HD) and a main board (MB) of a computer. The SATA cable assembly used for transmitting signals includes a connector and a cable connected thereto. The connector has two pair of signal contacts spaced apart by three grounding contacts. The cable also has two pair of wires coupled to the corresponding signal contacts. Each of the pair of wires is further shielded by conductive portions for coupled to the grounding contacts. The wires and the conductive portions both mechanically and electrically connected to the signal contacts and the grounding contacts via soldering process. However, it may be difficult to solder the conductive portions to the grounding contacts directly. Hence, a new method for terminating the connector and the cable is desired.

SUMMARY OF THE INVENTION

Accordingly, an object of the present invention is to provide a cable assembly with a grounding member used for connecting a shielding member of a cable and grounding contacts of an electrical connector.

In order to achieve the object set forth, a cable assembly in accordance with the present invention comprises an insulated housing extending along a front-to-back direction; a plurality of contacts arranged in a row and supported by the insulated housing, said contacts including three grounding contact members spaced by two pairs of signal contact members; a cable including two juxtaposed differential wire pairs respectively enclosed by conductive shielding portions; a grounding member including a main portion, three finger portions extending forwardly from a front side of the main portion and two arm portions formed at lateral sides of a rear segment of the main portion, said arm portion securely gripping the conductive shielding portion; and the finger portions soldered to the grounding contact members, and inner conductors of the differential wire pairs soldered to the signal contact members, respectively.

Other objects, advantages and novel features of the invention will become more apparent from the following detailed description when taken in conjunction with the accompanying drawings.

DETAILED DESCRIPTION OF PREFERRED EMBODIMENTS

Reference will now be made in detail to the preferred embodiment of the present invention.

Figure 1:
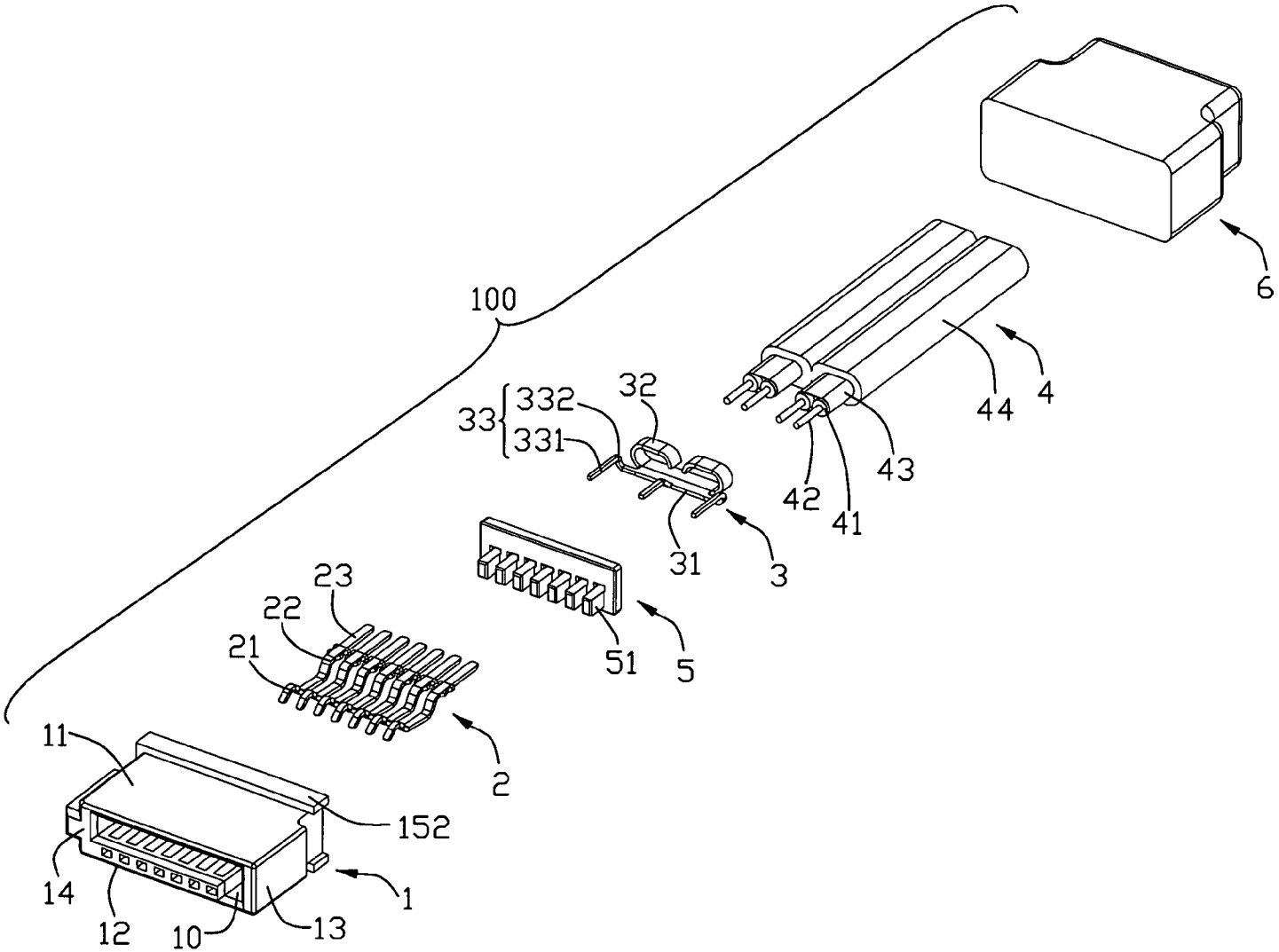
FIG. 1 is an exploded, perspective view of a cable assembly in accordance with the present invention.
Figure 2:
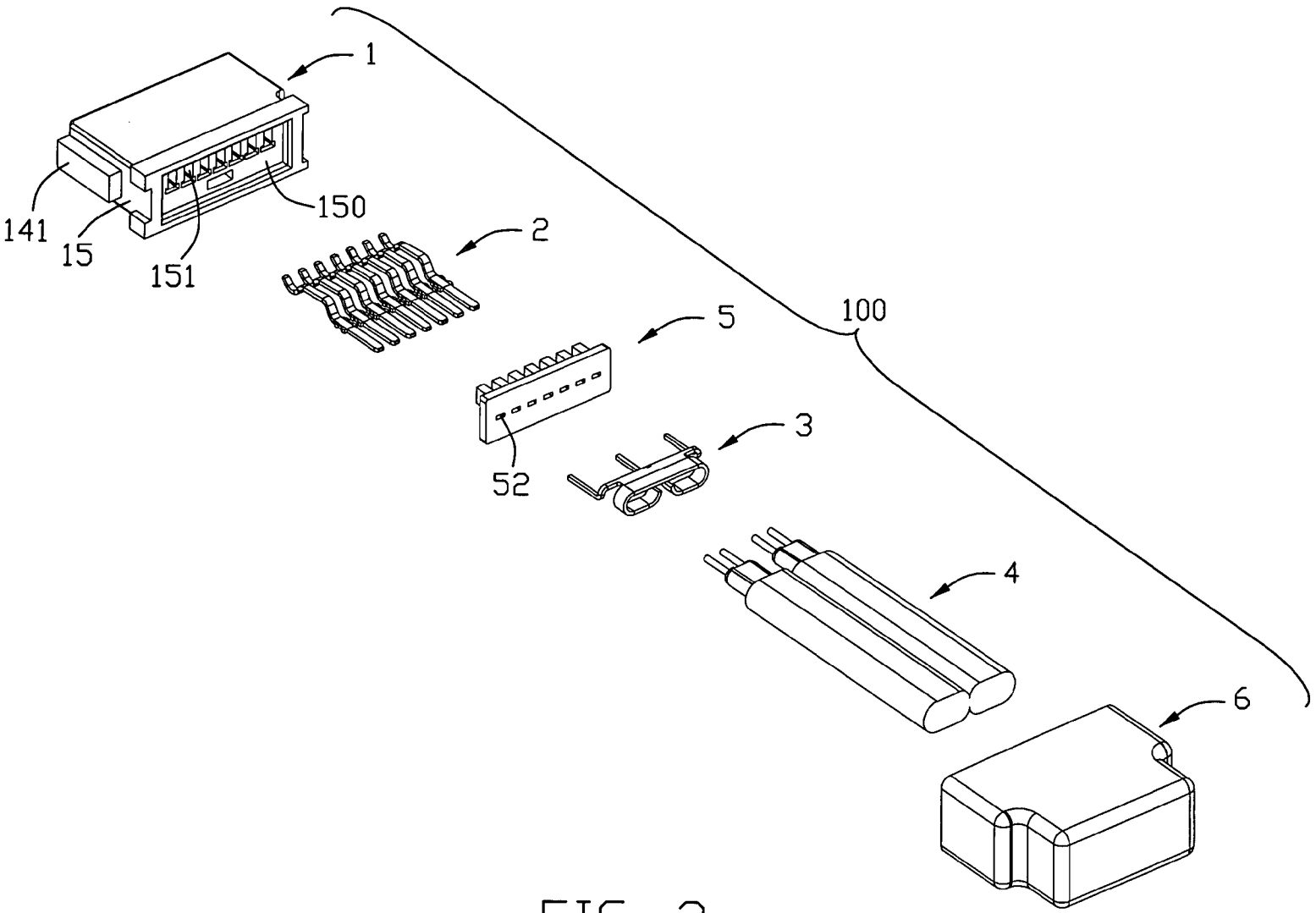
FIG. 2 is similar to FIG. 1, but viewed from other aspect.
Figure 3:
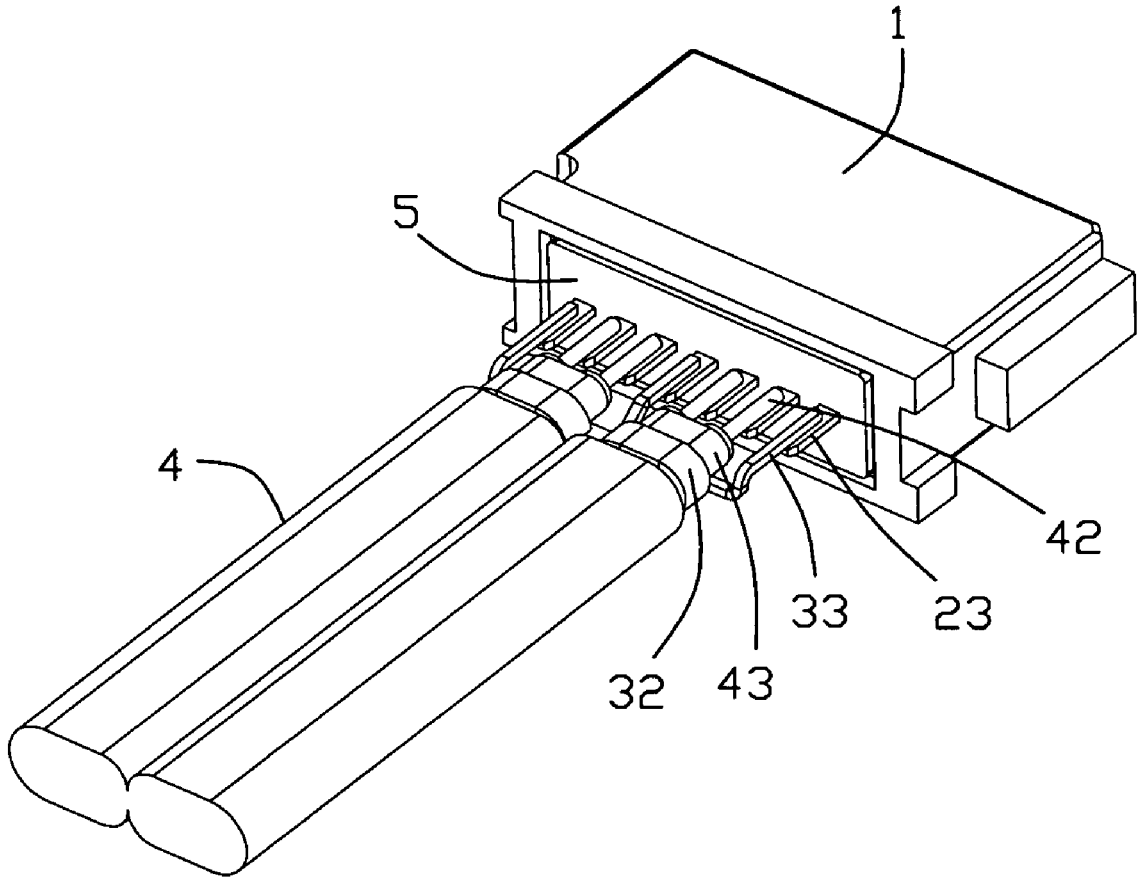
FIG. 3 is a partially assembled perspective view of the cable assembly.
Figure 4:
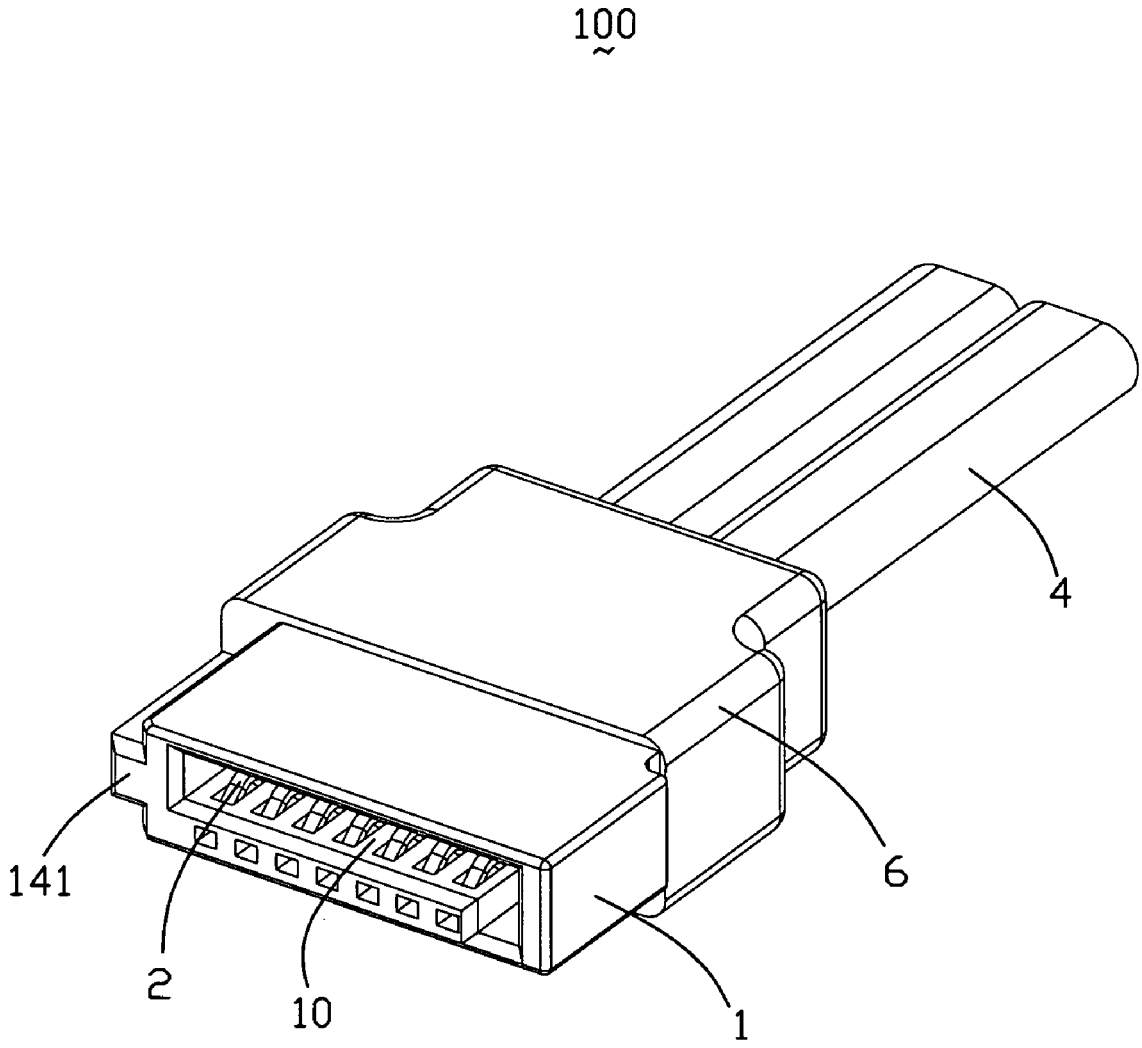
FIG. 4 is an assembled, perspective view of the cable assembly.

Referring to FIGS. 1-4, a cable assembly 100 in accordance to the present invention comprises an insulated housing 1, a number of contacts 2, a grounding member 3 and a cable 4.

The insulated housing 1 includes a top wall 11, a bottom wall 12, a pair of side walls 13, 14 interconnecting the top and bottom walls 11, 12 to together define an L-shaped mating port 10. A guiding member 141 is formed on an outer surface of the side wall 14. A depression portion 150 is defined in a back wall 15 of the insulated housing 1. A number of contact slots 151 are recessed forwardly from an interior side of the depression portion 150 and in communication to the mating port 10. Two flange members 152 are respectively arranged on the top and low surface of the back wall 15.

The contacts 2 has seven contact members which are arranged in a row along a transversal direction. The contact members include three grounding contacts and two pairs of signal contacts located between the grounding contacts. That is to say, the first, fourth and seventh positions of the row are grounding contacts, and the rest positions of the row are signal contacts. Each of the contacts 2 has a body portion 22 retained in the corresponding contact slot 151, a mating portion 21 extending into the mating port 10, and a tail portion 23 extending beyond the back wall 15 via the depression portion 150.

The cable 4 includes two differential wire pairs 41 arranged in juxtaposed manner, and each wire pairs 41 includes two inner conductors 42 insulated one another and enclosed within a conductive shielding portions 43, furthermore, a jacket 44 encloses the shielding portions 43. The conductive shielding portion 43 may be aluminum foil or copper foil. The jacket 44 of a front segment of the cable 4 is removed away to have the inner conductors 42 and the conductive shielding portions 43 exposed outside.

The grounding member 3 is made of metallic sheet and comprises a main portion 31, three finger portions 33 spaced apart each other and projected forwardly from the main portion 31, two arm portions 32 extending upwardly and inwardly from lateral sides of a rear segment of the main portion 31. Each finger portion 33 including transition portion 332 projecting upwardly from a front edge of the main portion 31 and a horizontal portion (front segment) 331 extending forwardly from the transitioning portion 332, thus the horizontal portion 331 is disposed higher than the main portion 31. The arm portions 32 entirely grip/clamp the conductive shielding portions 43, with free ends (not numbered) thereof extending into a gap (not numbered) between the two differential wire pairs 41. The horizontal portions 331 and the inner conductors 42 are arranged in a row at a same level and according to the row of contacts 2. The finger portions 33 are supported by and soldered to the tail portions 23 of the grounding contacts, while the inner conductors 42 of the two differential wire pairs 41 are located on and soldered to the tail portions 23 of the signal contacts.

A spacer member 5 is assembled to a depression portion 150 in the back wall 15 of the insulated housing 1. A number of holes 52 are defined in a middle section of the depression portion 150 for the tail portions 23 of the contacts 2 passing through, and a number of protruding members 51 are formed on a front surface of the spacer member 5 and project into the contacts slots 151. An insulator 6 is molded over the back wall 15, the tail portions 23 of the contacts 2, the grounding member 3, a partial of the jacket 4 adjacent to the grounding member 3.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. A cable assembly, comprising:

an insulated housing extending along a front-to-back direction;

a plurality of contacts arranged in a row and supported by the insulated housing, said contacts including three grounding contact members spaced by two pairs of signal contact members;

a cable including two juxtaposed differential wire pairs respectively enclosed by conductive shielding portions;

a grounding member including a main portion, three finger portions extending forwardly from a front side of the main portion and two arm portions formed at lateral sides of a rear segment of the main portion, said arm portion securely gripping the conductive shielding portion; and the finger portions soldered to the grounding contact members, and inner conductors of the differential wire pairs soldered to the signal contact members, respectively;

wherein the insulated housing has a number of walls together defining an L-shaped mating port;

wherein a number of contact slots are defined in a rear wall of the insulated housing to communicate with the mating port, and tail portions of the contacts extend outside the insulated housing via the contact slots.

2. The cable assembly as recited in claim 1, wherein the finger portions are disposed higher than the main portion.

3. The cable assembly as recited in claim 2, wherein front segments of the finger portions and the inner conductors are arranged in a line.

4. The cable assembly as recited in claim 3, wherein tail portions of the contacts extend outside of the insulated housing and support the finger portions and the inner conductors.

5. The cable assembly as recited in claim 4, wherein a depression portion is defined in a rear portion of the housing to accommodate a spacer therein, and a number of holes are defined in the spacer for the tail portions to pass through.

6. The cable assembly as recited in claim 5, wherein an insulator is molded over the rear portion of the housing, the grounding member and a jacket of cable adjacent to the grounding member.

7. The cable assembly as recited in claim 6, wherein two flange members are formed on an upper and lower surfaces of the rear portion of the housing and enclosed in the insulator.

8. The cable assembly as recited in claim 1, wherein a free end of each arm portion extends into a gap between the two differential wire pairs to fully hold a corresponding wire pair.

9. The cable assembly as recited in claim 1, wherein a spacer is mounted to the rear wall of the insulated housing, and a number of holes are defined in the spacer to let the tail portions through.

10. The cable assembly as recited in claim 9, wherein a number of protruding members are formed on a front surface of the spacer and project into the contact slots.

11. A cable connector comprising:

an insulative housing defining a plurality of passageways extending in a front-to-back direction;

a plurality of signal contacts disposed in the corresponding passageways, respectively;

a plurality of ground contacts disposed in the corresponding passageways, respectively;

a plurality of cables located behind the housing and defining a plurality of inner conductors soldered to tails of the corresponding signal contacts, respectively, and a plurality of outer conductors respectively surrounding said corresponding inner conductors and securely crimped by a grounding member; wherein said grounding member includes unitarily a plurality of forwardly extending fingers soldered to tails of the corresponding ground contacts, respectively; wherein the inner conductors are soldered to tails of the corresponding signal contacts, respectively; wherein the tails of the signal contacts and those of the ground contacts are located at a same level of the housing; wherein said grounding member defines a main body with said fingers extending therefrom in an offset manner toward said same level so as to have said fingers coplanar with the inner conductors for compliance with said same level for soldering to the tails of the signal contacts and the ground contacts.

12. The cable connector as claimed in claim 11, wherein each of said outer conductors is of a foil configuration essentially fully surrounds the corresponding inner conductors.

13. The cable connector as claimed in claim 12, wherein grounding member further includes a plurality of arm portions each extending from the main portion to essentially fully surround the corresponding outer conductor.

* * * * *